US007357671B2

(12) United States Patent
Wild et al.

(10) Patent No.: US 7,357,671 B2
(45) Date of Patent: Apr. 15, 2008

(54) COAXIAL PLUG-TYPE CONNECTOR AND METHOD FOR MOUNTING THE SAME

(75) Inventors: Werner Wild, Unterthürheim (DE); Rudolf Peschka, Frasdorf (DE)

(73) Assignee: Spinner GmbH, Munich (DE)

( * ) Notice: Subject to any disclaimer, the term of this patent is extended or adjusted under 35 U.S.C. 154(b) by 0 days.

(21) Appl. No.: 11/613,223

(22) Filed: Dec. 20, 2006

(65) Prior Publication Data

US 2007/0149047 A1 Jun. 28, 2007

(30) Foreign Application Priority Data

Dec. 22, 2005 (DE) ..... 10 2005 061 672

(51) Int. Cl.
*H01R 9/05* (2006.01)

(52) U.S. Cl. ..... 439/583; 439/827

(58) Field of Classification Search ..... 439/583, 439/578, 675, 827, 584, 579–582
See application file for complete search history.

(56) References Cited

U.S. PATENT DOCUMENTS 4,046,451 A 9/1977 Juds et al.
6,217,384 B1 4/2001 Strasser et al.
7,008,264 B2 3/2006 Wild

*Primary Examiner*—Javaid H. Nasri
(74) *Attorney, Agent, or Firm*—Edell, Shapiro & Finnan, LLC

(57) ABSTRACT

A coaxial plug-type connector including an approximately hollow-cylindrical plug-head with an outside thread, and a cable-side conical annular face as a contact face for an outer conductor of a coaxial cable, and a threaded sleeve with an inside thread as a cable clamping component, does not require a special contact sleeve. The plug-type connector has a short length since the threaded sleeve includes an interior conical annular face for clamping an end-face edge region of the outer conductor of the coaxial cable against the conical annular face of the plug-head. In order that tool engagement faces on the plug-head may be dispensed with, the plug-head includes on the plugging-in side an interior profile for accommodating in a form-locked manner an assembly tool. The plug-head is configured such that assembly of an inner plug conductor and a plug dielectric can be performed from the plugging-in side.

6 Claims, 4 Drawing Sheets

COAXIAL PLUG-TYPE CONNECTOR AND METHOD FOR MOUNTING THE SAME

CROSS REFERENCE TO RELATED APPLICATIONS

This application claims priority under 35 U.S.C. §119 to Application No. DE 102005061672.0 filed on Dec. 22, 2005, entitled "Coaxial Plug-Type Connector," the entire contents of which are hereby incorporated by reference.

BACKGROUND

A known plug-type connector includes a radially spring-mounted contact sleeve disposed within the connector coaxially with the threaded sleeve which serves to clamp to a cable. The radially spring-mounted contact sleeve is slit from the plugging-in side along the axial direction and has conical annular segments on the plugging-in side for clamping a first corrugation of an annularly corrugated coaxial cable terminated at a corrugation ridge against the conical annular face of the plug-head by means of the threaded sleeve. Although this design makes it possible to position the entire plug-type connector as a prefabricated unit onto the coaxial cable, and to connect it thereto, it has the disadvantage of requiring a large outlay of material and manufacturing effort, owing chiefly to the shape and the function of the contact sleeve.

Another known coaxial plug-type connector of the type mentioned above includes a radially elastic locking ring accommodated inside the screw sleeve in a first interior groove to which a second interior groove of smaller diameter is contiguous on the cable side, so that the locking ring becomes compressed along a radial direction when the threaded sleeve is screwed onto the plug-head, and thereby clamps the end-face edge region of the outer cable conductor against the conical annular face of the plug-head.

Another plug-type connector is known which comprises an approximately hollow-cylindrical plug-head having an inside thread and a cable-side annular conical face as a contact face for an outer conductor of a coaxial cable, and a threaded sleeve as a cable clamping means. On the plug-in side of its outside thread, the screw sleeve is designed, by means of axial slits, to be simultaneously a radially spring-mounted contact sleeve having plug-in side conical annular segments for clamping the end-face edge region of the cable outer conductor to the conical annular face of the plug-head. Consequently, the plug-type connector is of comparatively large length. Assembly problems and, as a consequence thereof, an irregular circumferential contact between the cable outer conductor and the plug-head may result from a distortion caused by friction between the conical annular segments and the cable outer conductor, as well as from an upsetting deformation, occurring non-symmetrically along the circumference, of the lamella-like sections of the threaded sleeve between its conical annular segments and its outside thread.

SUMMARY

The plug-type connector described herein is of high-quality, yet of low manufacturing cost. In particular, a coaxial plug-type connector comprises an approximately (substantially) hollow-cylindrical plug-head with an outside thread and a cable-side conical annular face as a contact face for an outer conductor of a coaxial cable, and a threaded sleeve operable to clamp a cable.

In accordance with the described device, the threaded sleeve includes an interior continuous conical annular face for clamping the end-face edge region of the outer conductor of the coaxial cable against the conical annular face of the plug-head.

As distinct from the known plug-type connector mentioned above, the threaded sleeve thus not only performs mechanical clamping of the cable, but also effects its electrical contacting with the plug-head. Dispensing with a special contact sleeve not only reduces manufacturing costs, but also makes possible a particularly short and therefore material-saving design, whereby the amount of material expended and also the duration of processing, and therewith the manufacturing costs, are further reduced.

When the plug type connector is intended for a coaxial cable having an annularly corrugated outer conductor, the threaded sleeve must first be slid onto the cable outer conductor. For this, the double function of the threaded sleeve requires the cable outer conductor to be radially compressed at the position of the end corrugation ridge to the extent that the threaded sleeve, including at the inside edge of its conical annular face an interior shoulder that is matched to the diameter of the cable outer conductor at the position of a corrugation groove, may be slid over the end-face edge of the cable outer conductor. Subsequently, the end-face edge region of the cable outer conductor must be re-widened, for example via an assembly tool. The threaded sleeve is then seated loosely, yet without risk of becoming lost, on the end of the coaxial cable.

For assembly, the plug-head and the threaded sleeve must be locked together in usual manner. For this, spanner engagement faces (i.e., tool engagement faces, e.g., wrench engagement faces) may be formed on both parts. However, a further saving of material and processing time is achieved by dispensing with spanner engagement faces on the plug-head, because the plug-head then may be made shorter by at least the width of the spanner engagement faces. A particularly preferred embodiment of the plug-type connector therefore is a plug-head including, on the plugging-in side, an interior profile for form-locked accommodation of an assembly tool. This interior profile may be, for example, an interior hexagonal profile, or a multiple-tooth profile. When the constructional rules known by a plug designer are observed, the plug-type connector will have in the region of its interior profile the same electrical properties as a conventional plug-type connector having a plug-head interior profile of circular cross-section.

It is expedient to design the plug-head such that an assembling of a conventional inner plug conductor and a conventional dielectric may be effected from the plugging-in side. With this embodiment, the entire recess depth of the plug-head is accessible on the plugging-in side for accommodating an assembly tool for screwing together the plug-head and the threaded sleeve.

Final assembly in the field becomes simpler when the inner plug conductor and the plug dielectric are configured to be jointly inserted into the plug-head as a prefabricated unit.

On the cable side, the plug-head may have a flat recess for accommodating the end-face section of a cable dielectric. On the one hand, this facilitates centered positioning of the plug-head onto the cable end-face edge, and on the other hand prevents an axial upsetting of the cable dielectric when the plug-head and the threaded sleeve are screwed together.

Because plug-type connectors of this kind are frequently intended for coaxial cables with tubular inner conductors, it is recommended that the cable side of the inner plug conductor be configured for spring-mounted engagement with a tubular inner cable conductor of this kind. Thereby, it becomes possible to allow for a wide range of diameters of inner cable conductors.

A method for mounting the proposed plug-type connector onto a coaxial cable with an annularly corrugated outer conductor and a tubular inner conductor can be performed as follows:

(a) terminating the cable at approximately a position of a corrugation ridge of the outer conductor;

(b) radially compressing the end-face edge of the cable;

(c) sliding the threaded sleeve onto the outer cable conductor;

(d) edge-raising the end-face edge region of the outer cable conductor;

(e) positioning the plug-head onto the cable end;

(f) screwing together the plug-head and the threaded sleeve using an assembly tool inserted in form-locked manner into the plug-head from the plugging-in side;

(g) pressing the inner plug conductor and the plug dielectric into the plug-head.

However, if the plug-type connector is intended to be mounted onto a coaxial cable having a smooth outer conductor, then the assembly involves operations (c) to (g).

The above and still further features and advantages of the described device and method will become apparent upon consideration of the following definitions, descriptions and descriptive figures of specific embodiments thereof, wherein like reference numerals in the various figures are utilized to designate like components. While these descriptions go into specific details of the device and method, it should be understood that variations may and do exist and would be apparent to those skilled in the art based on the descriptions herein.

BRIEF DESCRIPTION OF THE DRAWINGS

The invention is explained in more detail below with reference to exemplary embodiments, where.

DETAILED DESCRIPTION

Figure 1:
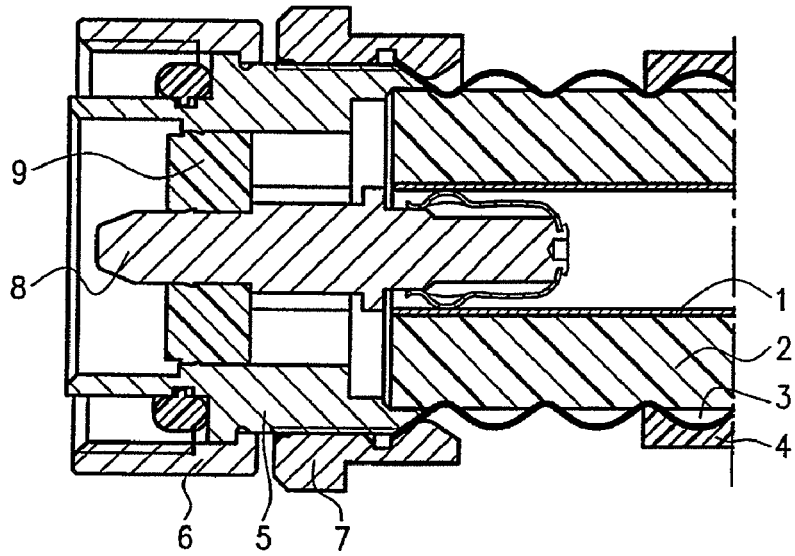
FIG. 1 shows a longitudinal section of a plug-type connector mounted on a coaxial cable with an annularly corrugated outer conductor.

In FIG. 1 the plug-type connector is completely mounted onto the end of a coaxial cable having an annularly corrugated outer conductor. The coaxial cable comprises a tubular inner conductor 1, a cable dielectric 2, the annularly corrugated outer cable conductor 3, and a cable sheath 4.

The plug-type connector comprises a plug-head 5 with a union nut 6 on the plugging-in side, and a threaded sleeve 7 on the cable side. The plug-type connector establishes electrical contact with the outer cable conductor 3 and mechanically clamps the cable, i.e., effects a connection between the plug-type connector and the cable, such that the cable is safeguarded from being extracted from the connector. Furthermore, the plug-type connector comprises an inner plug conductor 8 and a plug dielectric 9.

Figure 2:
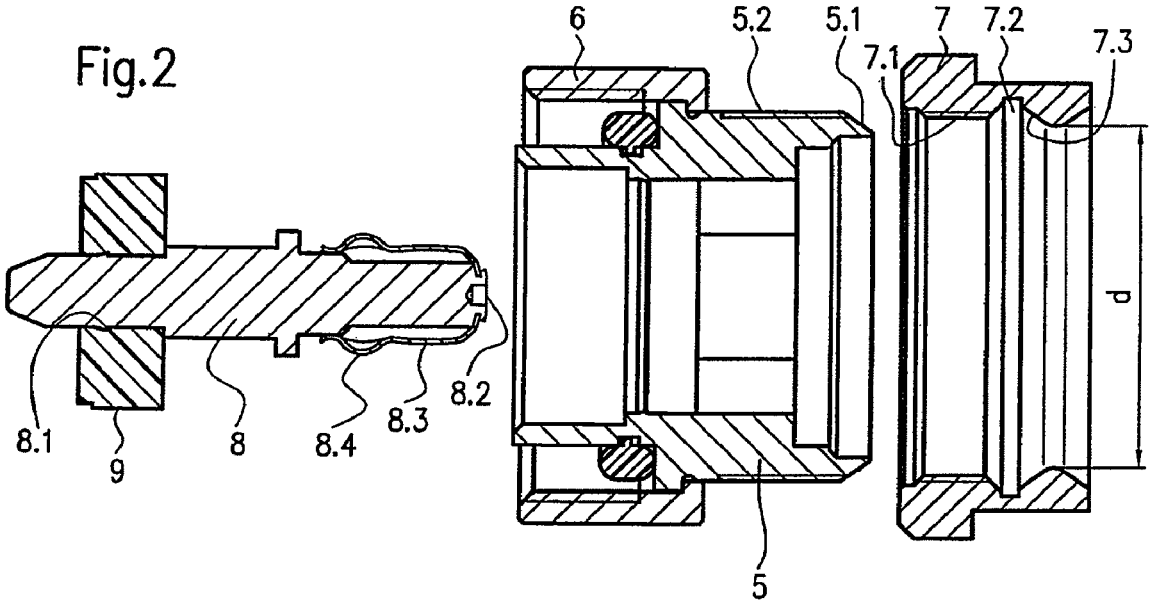
FIG. 2 to FIG. 9 show the assembly steps.

FIG. 2 illustrates the component parts of the plug-type connector as kept available for assembly. The inner plug conductor 8 and the circular-disk-shaped plug dielectric 9 form a prefabricated unit. The inner plug conductor 8 includes a small circumferential collar 8.1 with saw-tooth profile. Thereby, the plug dielectric 9 is held safeguarded from being extracted after having been pressed onto the pin side of the plug inner conductor 8 and a longitudinal watertight seal is obtained between the plug dielectric and the outer cable conductor. On the cable side, the inner plug conductor 8 includes a contact cage 8.3 that is fixed by a rivet 8.2 and is axially slotted and is thereby radially spring-mounted. The contact cage 8.3 includes a circumferential bow portion 8.4 formed by spherical caps that act as a contact surface.

The plug-head 5 is designed such that the union nut 6 may be slid-on from the cable side. On the cable side, the plug-head has a conical annular face 5.1 adjacent to an outside thread 5.2.

The threaded sleeve 7 comprises: spanner engagement faces on its outer circumference, which are not shown here, an inside thread 7.1, an interior annular groove 7.2 that is contiguous to the inside thread on the cable side, and an interior conical annular face 7.3 that is in turn contiguous to the interior annular groove and has an inner diameter d.

Figure 3:
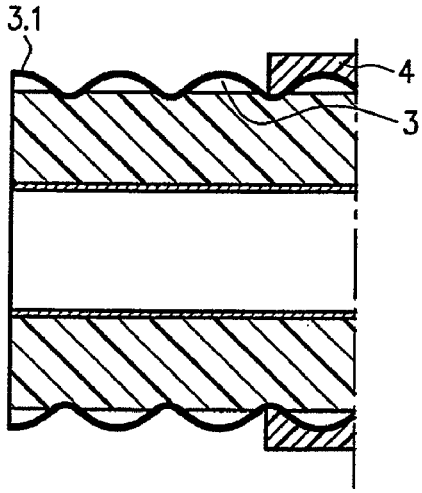

FIG. 3 shows the coaxial cable that is terminated at approximately the position of the first corrugation ridge 3.1 of the outer cable conductor 3, together with a suitably set-back cable sheath 4.

Figure 4:
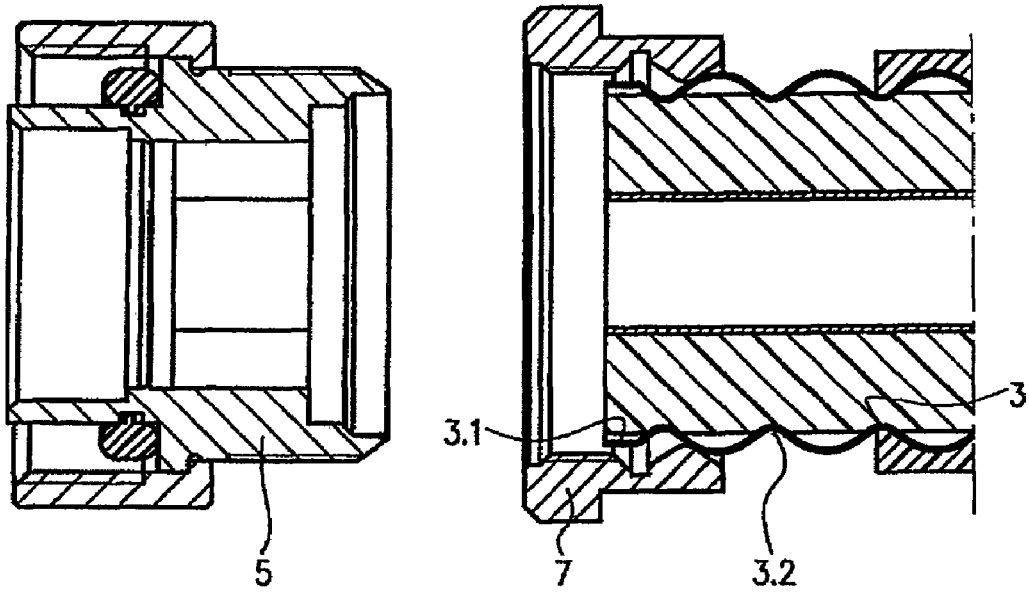

FIG. 4 shows the threaded sleeve 7 slid onto the outer cable conductor. Prior to being slid on, the cable outer conductor 3 is compressed at the position of the first corrugation ridge at 3.1 via a suitable tool to a diameter that is smaller than the diameter d in FIG. 2. FIG. 4 also shows that the diameter d is larger than the diameter of the outer cable conductor 3 in the region of a corrugation groove 3.2.

Figure 5:
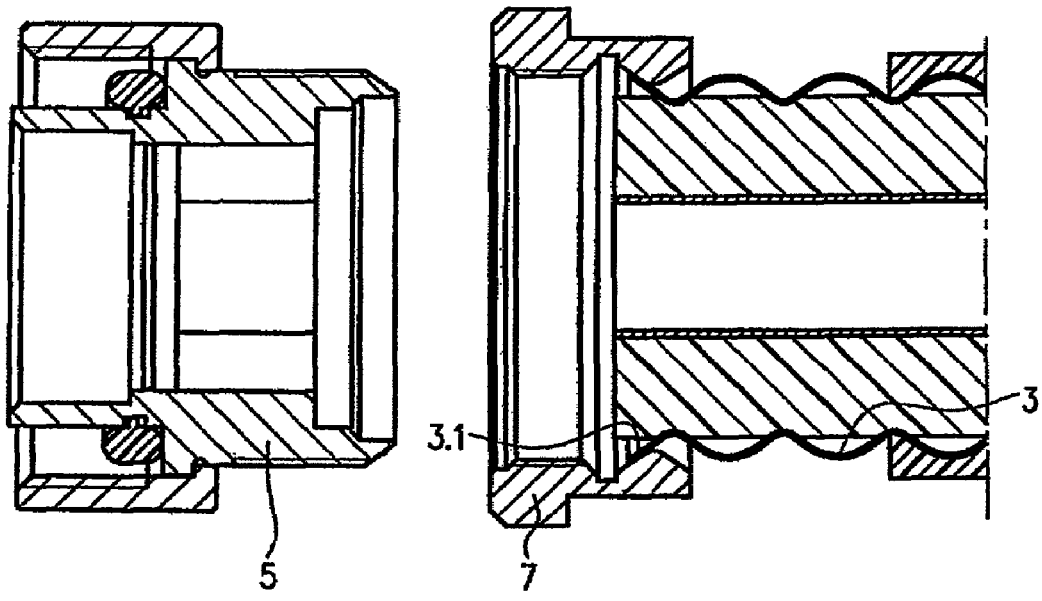

In the assembly step illustrated by FIG. 5, the cut first corrugation ridge of the outer cable conductor 3 is now edge-raised to form a contacting end-face region 3.1. For this, for example, the tool later to be described may be used. The threaded sleeve 7 is now seated loosely, but safeguarded from loss, on the outer cable conductor 3.

Figure 6:
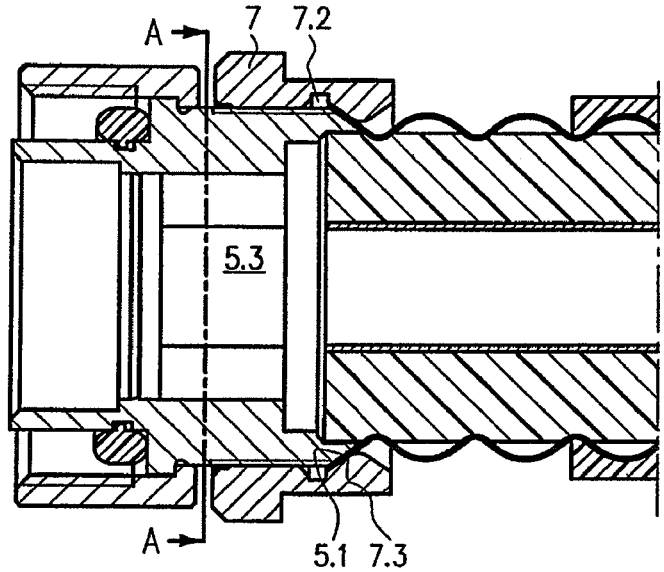

In the next step, the threaded sleeve is slid back into the position shown in FIG. 4, and the plug-head 5 is placed onto the cable end. With the plug-head 5 preferably being held fixed, the threaded sleeve 7 is then screwed onto the plug-head 5. During this, the end-face edge region 3.1 of the outer cable conductor 3 is clamped between the corresponding conical annular faces 5.1 and 7.3 of the plug-head 5 and the threaded sleeve 7, respectively, as shown in FIG. 6. If the edge-raising of the end-face edge region 3.1 causes a projecting burr to remain or form, or, if other irregularities of the circumference are present, the interior annular groove 7.2 of the threaded sleeve 7 will offer sufficient space for accommodating this burr which, particularly when it occupies only parts of the circumference of the end-face edge region 3. 1, could create alignment or contacting problems.

Figure 7:
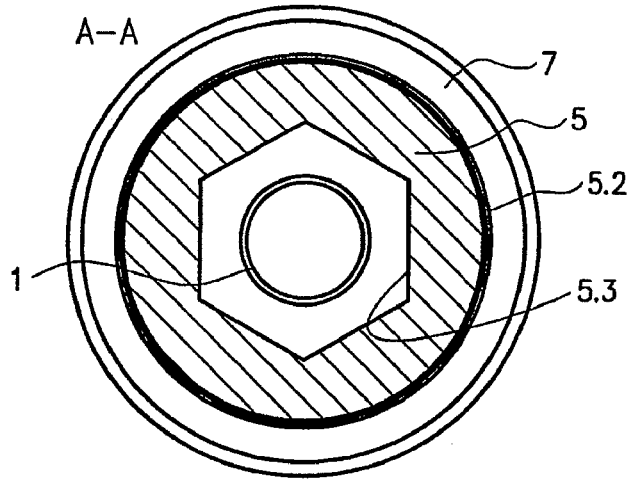

As may be seen, for example from the FIGS. 1 and 6, to save material and processing time, the plug-head 5 is designed to be sufficiently short along the axial direction so that no space remains for spanner engagement faces (i.e., tool engagement faces, e.g., wrench engagement faces) for positioning a fork spanner—other than at the outer periphery of the threaded sleeve 7. However, considerable torque is required for tightening the threaded sleeve 7, so that the plug-head 5 must be held counter-braced. For this, the plug-head includes, for example, an inside hexagonal profile 5.3, as shown particularly in FIG. 7 by the cross-section along the line A-A of FIG. 6. Via a not-illustrated assembly tool that comprises a corresponding outer hexagonal profile and may include, in addition, a centering pin engaging with the inner cable inner conductor, the plug-head 5 is fixed relative to the cable, while the threaded sleeve 7 is being screwed on.

In the last step, the unit shown in FIG. 2 and comprising the inner plug conductor 8 and the plug dielectric 9 are pressed into the plug-head 5 from the plugging-in side.

Figure 8:
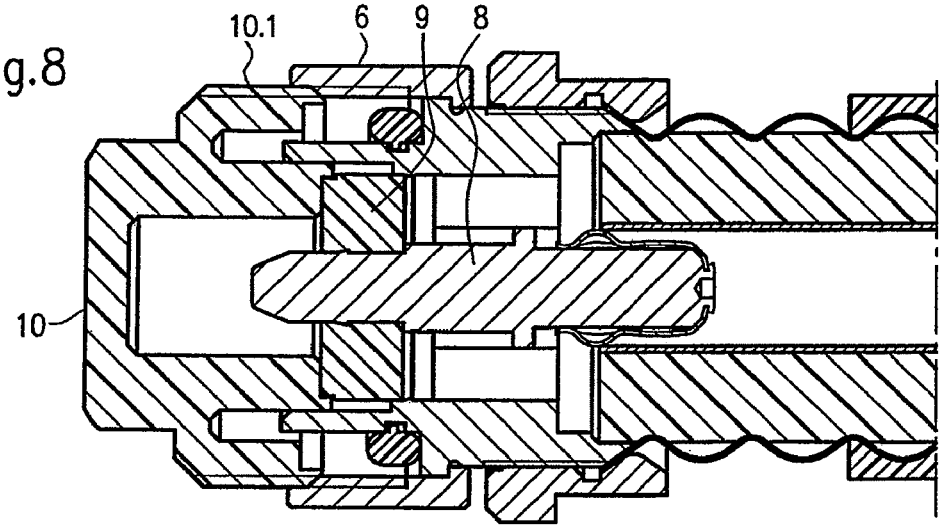
Figure 9:
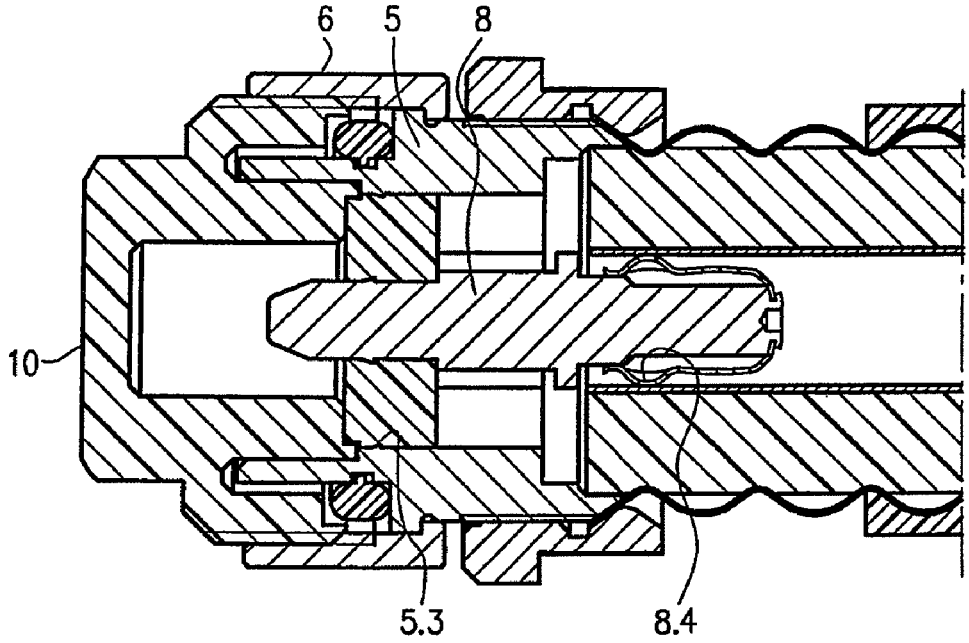

FIG. 8 shows the initial position and FIG. 9 the final position at which the assembly of the plug-type connector is completed. For the pressing-in operation, the tool 10 shown in FIGS. 8 and 9 can be used. The cable-side end-face edge of its substantially pot-shaped body is seated on an insulating-material disk 9 (e.g., the plug dielectric 9). A shoulder on the end face of the tool 10, which is complementary to a shoulder on the outer periphery of the insulating-material disk 9, serves for the centering. The tool 10 includes on its outer periphery an outside thread 10.1 fitting to the inside thread of the union nut 6 of the plug-type connector. The tool 10 may be equipped with any desired manipulation aids, e.g., tool engagement faces adjacent to the outside thread, or a cross-arbor (not illustrated). After the assembly has been completed, the bow portion 8.4 of the inner plug conductor 8 contacts the inside of the inner cable conductor 1 in a region close to the end-face edge. The unit comprising the inner plug conductor 8 and the plug dielectric 9 is retained in the plug-head by a small interior shoulder 5.3 with a saw-tooth profile, so as to be safeguarded from being extracted. Finally, of course, the tool 10 is removed.

Figure 10:
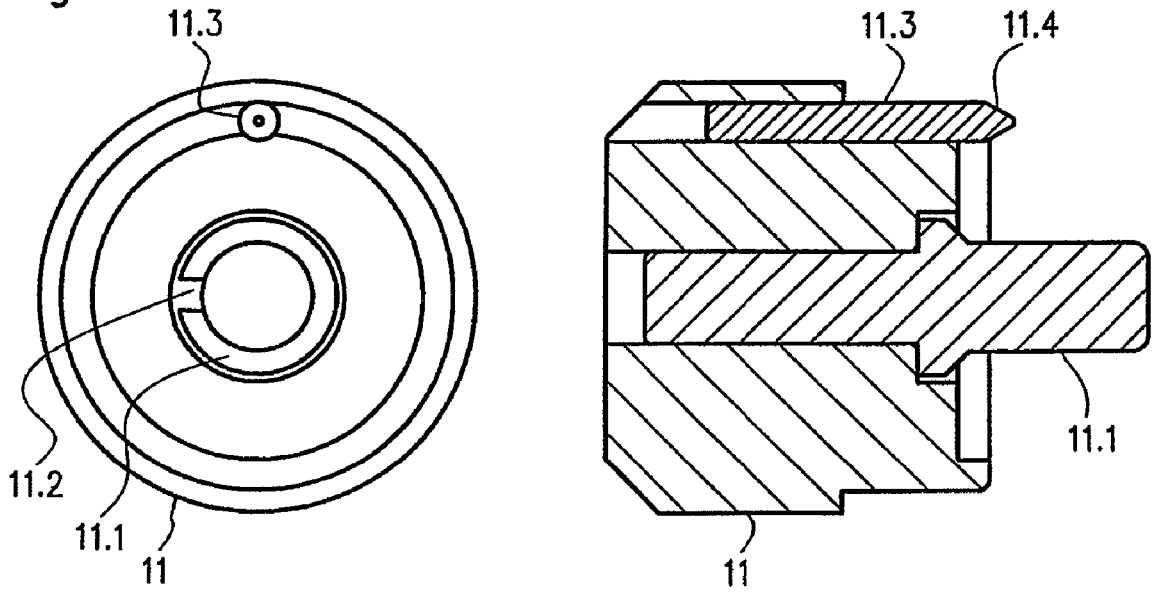
FIG. 10 shows a tool for edge-raising the end-face edge region of the outer cable conductor.

FIG. 10 illustrates a plan view and a longitudinal cross-section of an example of a tool 11 for widening or edge-raising the end-face edge region of the outer cable conductor, which in the above example is the region 3.1 of the outer cable conductor 3. The tool comprises a cylindrical body including a centering pin 11.1, the projecting portion of which engages in the inner cable conductor 1 during the edge-raising operation. As may be seen from the end view, the centering pin 11.1 comprises an axial slot 11.2 serving to remove, at the same time as the edge-raising operation on the cable outer conductor, any burr that may have been formed on the inner cable conductor 1 during the termination of the cable. On its outer periphery the tool 11 further comprises a pin 11.3 with a conical tip 11.4 that becomes positioned between the cable dielectric 2 and the cable outer conductor 3 when the tool is applied, such that during rotation of the tool 11, the outwardly directed face of the conical tip 11.4 urges the material of the outer cable conductor outwards.

While the device and method have been described in detail with reference to specific embodiments thereof, it will be apparent to one of ordinary skill in the art that various changes and modifications can be made therein without departing from the spirit and scope thereof. Accordingly, it is intended that the described device and method cover the modifications and variations provided they come within the scope of the appended claims and their equivalents.

What is claimed is:

1. A coaxial plug-type connector comprising:

A substantially hollow-cylindrical plug-head with an outside thread, and a cable-side conical annular face as a contact face for an outer conductor of a coaxial cable; and a threaded sleeve with an inside thread configured to clamp a cable, wherein the threaded sleeve includes an interior conical annular surface for clamping an end-face edge region of the outer conductor of the coaxial cable against the conical annular face of the plug-head.

2. The plug-type connector according to claim 1, wherein the plug-head further comprises an inner profile on a plugging-in side for accommodating an assembly tool in a form-locked manner.

3. The plug-type connector according to claim 1, wherein the plug-head is configured for an inner plug conductor and a plug dielectric to be assembled from a plugging-in side.

4. The plug-type connector according to claim 3, wherein the inner plug conductor and the plug dielectric are configured to be inserted into the plug-head as a prefabricated unit.

5. The plug type connector according to claim 3, wherein the inner plug conductor is configured, on a cable side, for spring-mounted engagement with a tubular inner cable conductor.

6. The plug-type connector according to claim 1, wherein the plug-head further comprises a recess on a cable side for accommodating an end-face section of a cable dielectric.

* * * * *